US005193866A

United States Patent [19]

Driskill et al.

[11] Patent Number: 5,193,866

[45] Date of Patent: Mar. 16, 1993

[54] TRANSPORTABLE POSITIVE DEAD BOLT LOCK FOR DOORS

[75] Inventors: Carl R. Driskill, Arlington; Warren H. Kintzinger, Richardson, both of Tex.

[73] Assignee: Electro II Energy Management Systems, Inc., Amarillo, Tex.

[21] Appl. No.: 872,989

[22] Filed: Apr. 29, 1992

[51] Int. Cl.[5] ..... E05B 17/36

[52] U.S. Cl. ..... 292/292

[58] Field of Search ..... 292/292-296, 292/289

[56] References Cited

U.S. PATENT DOCUMENTS

| | | | |
|---|---|---|---|
| 1,970,485 | 8/1934 | Bins | 292/292 X |
| 3,731,965 | 5/1973 | Adkinson, Jr. | 292/292 |
| 3,913,962 | 10/1975 | Briggs | 292/292 |

*Primary Examiner*—Richard E. Moore

*Attorney, Agent, or Firm*—Warren H. Kintzinger

[57] ABSTRACT

A portable positive dead bolt lock temporarily installed in a door frame and then removed and carried from one location to another to present, while temporarily used, a positive dead bolt lock. A planar lock plate is provided having a tab flange extended laterally into a notch opening in the door frame when installed, and an opening large enough to permit passage of the head of the dead bolt. An entry slot is provided from the opening extended to a pair of slot extensions therein in diverging relationship relative to the entry slot with one of the slot extensions extending up and the other extending down. Each of the slot extensions having one edge presenting a plurality of seats each presenting a vertical seat edge. The dead bolt having a groove between a head and the bolt body permitting passage of the bolt through the entry slot and into the slot extensions. Springs bias the lock plate toward the door frame when the door is closed.

6 Claims, 2 Drawing Sheets

TRANSPORTABLE POSITIVE DEAD BOLT LOCK FOR DOORS

Figure 1:
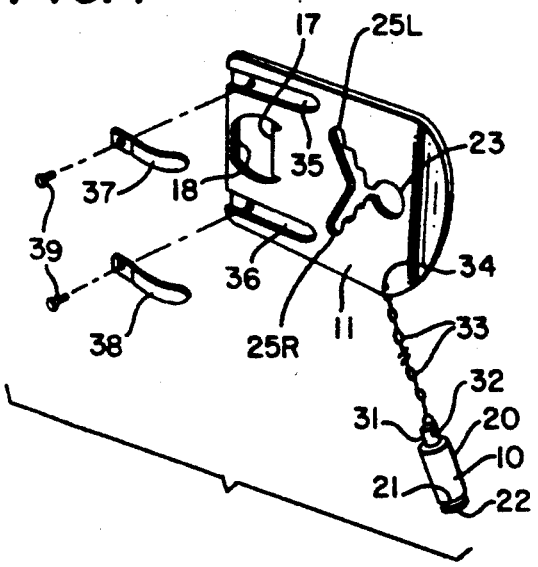

This invention relates in general to door locks, and more particularly, to dead bolt locks and especially a positive dead bolt lock easily transferred from door to door.

Bolt action locks mounted on a door jamb, or frame, have long been known as the surest way of locking a door from the inside. While effective the appearance of dead bolt locks generally is such as to mitigate against their overall use in many areas. It follows that a lock system is looked for that provides the security of a positive dead bolt lock and that is easily transferable from location to location, from door to door. Many people travel extensively both in and out of the country and stay at times in inns, motels and hotels, where there may be a question as to how many keys are out, where a temporarily used positive dead bolt lock would be most helpful in providing security desired once in a room in a strange location.

It is therefore, a principal object of this invention to provide a positive dead bolt lock structure for greater lock security.

Another object is to provide such a dead bolt lock structure that is transportable for use on different doors.

A further object is to provide such a dead bolt lock structure that is relatively inexpensive.

Still another object is to provide such a dead bolt lock structure that is easy to install and remove from doors.

Features of the invention useful in accomplishing the above objects include, in a transportable positive dead bolt lock for doors, a portable small size convenient to use portable dead bolt lock temporarily installed in a door frame and then removed and carried from one location to another to present, while temporarily used, a positive dead bolt lock.

Specific embodiments representing what are presently regarded as the best modes of carrying out the invention are illustrated in the accompanying drawings.

Figure 3:
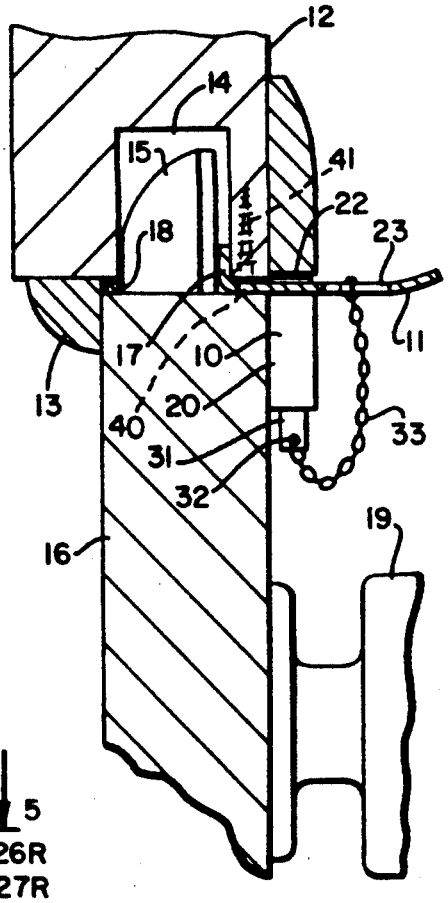
Figure 2:
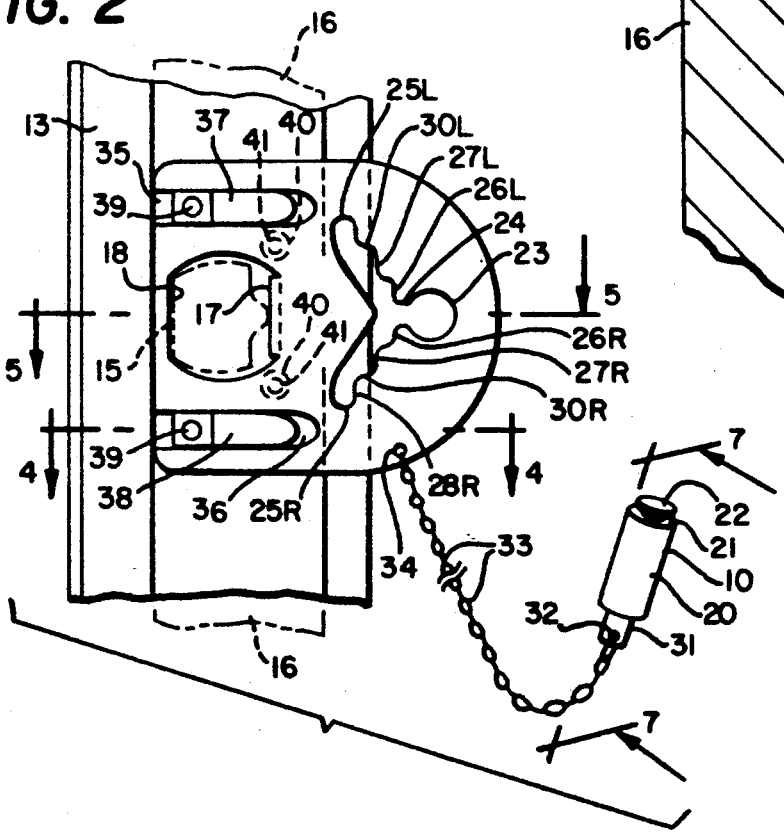
Figure 4:
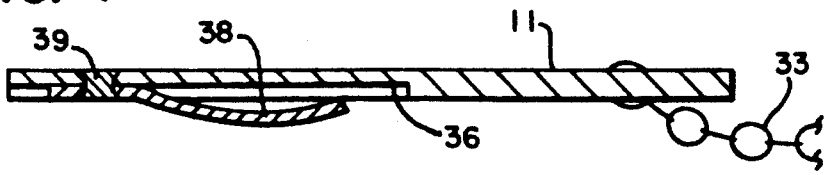
Figure 5:
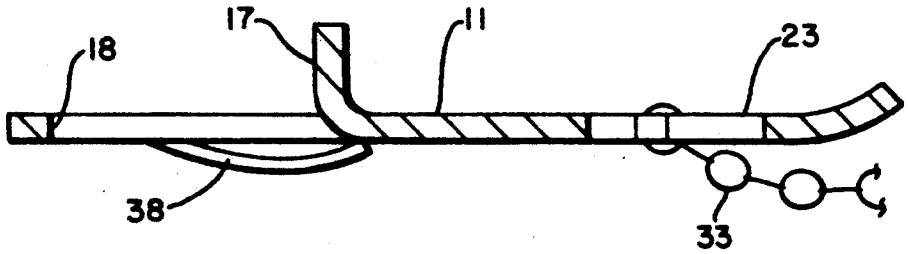

In the drawings:

FIG. 1 represents a perspective view of the door lock keeper plate like dead lock plate with positive bias springs exploded away;

FIG. 2, an elevation view of the dead lock plate of FIG. 1 mounted on a door closure frame of a right hand opening door;

FIG. 3, a horizontal view in cross-section through a portion of the door and door frame with the dead lock bolt structure in place;

FIG. 4, a horizontal sectioned view along line 4—4 of FIG. 2 of the dead lock plate and a plate bias spring;

FIG. 5, a horizontal sectioned view along line 5—5 of FIG. 2 of the dead bolt lock plate through the center thereof.

Figure 6:
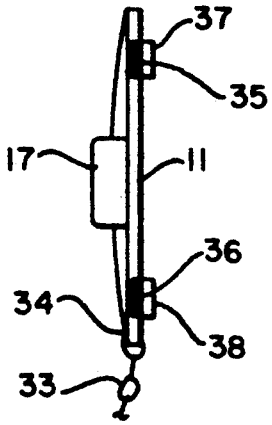
Figure 7:
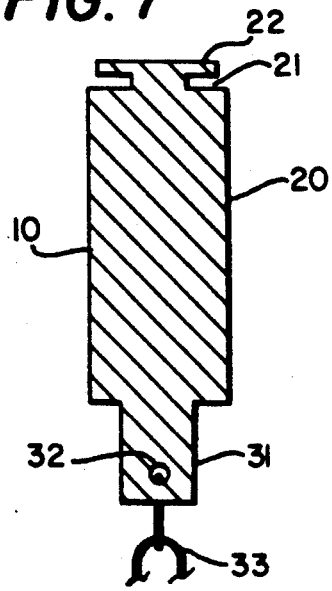
Figure 8:
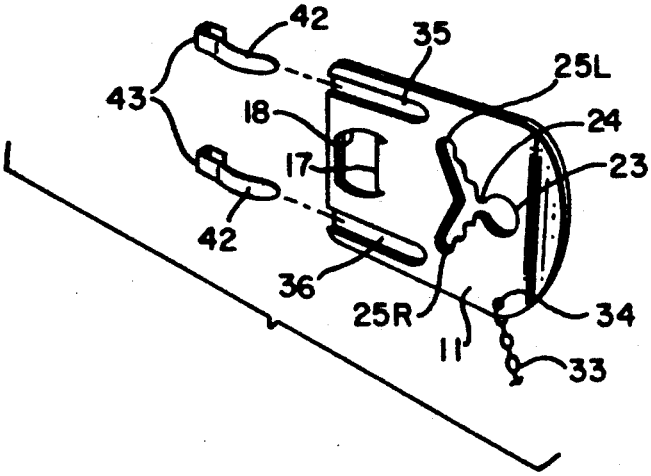

FIG. 6, a back elevation view of the dead bolt lock plate of FIGS. 1-5;

FIG. 7, a section view of the dead bolt of FIGS. 1-3 taken along line 7—7 of FIG. 2; and, FIG. 8, a perspective view of a door dead lock plate like the plate of FIG. 1 with different position bias springs exploded away.

The dead bolt 10 lock plate 11 of FIG. 1 is shown to be positioned on a door frame 12, in FIGS. 2 and 3, with a door jamb 13 and with a notch opening 14 in the door frame 12 for receiving the door latch 15 when door 16 is closed. A laterally extended tab 17, extending substantially at right angles from the plane of lock plate 11 extends into notch opening 14 to help hold dead bolt lock plate 11 in place on door frame 12. Opening 18 in dead bolt lock plate 11 conforms to notch opening 14 with tab 17 at the front end thereof extending into the front end of opening 14 and with the door latch 15 extendable therethrough into door frame notch opening 14. Door latch 15 is generally biased into its extended position by spring means and is moved to a retracted position within the door 16 by turning of a door knob 19.

The dead bolt 10, or keeper pin, action member that cannot be forced or manipulated from outside the door 16, may along with the lock plate 11 be made from non magnetic stainless steel. The dead bolt action member is made with, at one end from the cylindrical body 20, a groove 21 and an annular circular head 22 of less diameter than body 20 to pass through opening 23 of lock plate 11 that will not pass cylindrical body 10. The annular groove 21 rides through an entry slot 24 to the two repaired slot extensions 25R and 25L that are mirror images of each other extended in opposite angled directions relative to each other from the common entry slot 24. The slot extensions 25R and 25L diverge away from the common entry slot 24 in a broken "V" configuration with each of the slot extensions having a rear edge with a series of curvilinear lines presenting a plurality of vertical seats 26R, 26L, 27R, 27L, 28R and 28L with different spacing relative to the door 16. The spacing between edges 29R and 29L of slot extensions 25R and 25L and the saw toothed edges 30R and 30L with vertical seats 26R, 26L, 27R, 27L, 28R and 28L is always narrow enough that the dead bolt action member 10 body 20 and circular head 22 will not pass therethrough but only head 22 in and out of entrance opening 23 when in alignment therewith. The dead bolt action member 10 is passed down the slot 25R in the right hand door installation shown in FIGS. 2 and 3 and down the slot 25L when the dead bolt lock plate 11 is flipped over for a left hand door installation.

A rear extension 31 of dead bolt 10 is provided with opening 32 for keeper chain 33 the other end of which is connected through hole 34 in lock plate 11.

A pair of parallel grooves 35 and 36 are provided one above opening 18 and one below opening 18 for leaf springs 37 and 38 duplicates one of the other riveted with flat headed rivets 39 into the respective grooves 35 and 36. The leaf springs 37 and 38 with an arcuate shape are resiliently deflectabe into their respective grooves 35 and 36 by the door 16 to help hold lock plate 11 in place with tab 17 extending into door frame opening 14. A further aid to holding lock plate 11 in place are the plate screw openings 40 through which screws 41 may be tightened down into door frame 12.

In the embodiment of FIG. 8 an alternate spring 42 is formed of resilient spring band steel with a formed over "U" shaped rear end 43 that clamp fits the lock plate 11 with, other than the rivet mounting of FIGS. 2 and 4, is the same as springs 33 and 34.

Whereas this invention has been described with respect to more than one embodiment thereof, it should be realized that various changes may be made without departure from the essential contributions to the art made by the teachings hereof.

We claim:

1. A portable positive dead bolt lock, for use with doors having a latch receivable in a notch opening in the door frame, comprising: a planar lock plate adapted to be disposed between the door and the frame; tab flange means extended laterally from said planar lock plate adapted to be received in said notch when said planar lock plate is placed on said door frame and especially when said planar lock plate is placed between the door frame and the door; said planar lock plate having a pair of slot extensions therein in diverging relationship relative to a horizontal line passed through said planar lock plate when said tab flange means is received in said notch with one of the pair of slot extensions extending up and the other of said pair of slot extensiond extending down; each of said pair of slot extensions having at least one edge thereof presenting a plurality of seats each presenting a substantially vertical seat edge; and dead bolt means receivable in the lower of said slot extensions when said planar lock plate is in place between the door and the door frame with said dead bolt means positioned in the seat adjacent the door thereby presenting a dead bolt lock opposing opening of the door; said dead bolt means has a body; a head of less cross-sectional area of the body of said dead bolt; a groove between said head and the body of said dead bolt; said planar lock plate has an entrance opening large enough to permit passage therethrough of said head of the dead bolt; and entry slot passage means interconnecting said entrance opening and said pair of slot extensions; said entrance opening and said pair of slot extensions all narrow enough not to permit passage therethrough of said dead bolt body and said head; and wherein said planar lock plate mounts resilient spring means providing resilient spring force on said planar lock plate toward the door frame when said door is closed.

2. The portable positive dead bolt door lock of claim 1, wherein said resilient spring means includes two springs that are band steel springs mounted by flat headed rivets in spring relief position slots in said planar lock plate with said relief position slots wide enough and long enough to receive said springs as they are resiliently deflected by closure of the door.

3. The portable positive dead bolt door lock of claim 2, wherein said two springs that are band steel springs have an arcuate shape that is resiliently deflectable by said door toward a flattened state.

4. The portable positive dead bolt door lock of claim 1, wherein a latch opening is provided in said planar lock plate that generally conforms to said notch opening in said door for passage therethrough of the door latch; said resilient spring means includes two springs that are band steel springs with formed over ends that clamp fit said planar lock plate at the back edge thereof; spring relief position slots in said planar lock plate in generally parallel horizontal relation one above said latch opening and one below said latch opening.

5. The portable positive dead bolt door lock of claim 1, wherein said planar lock plate is provided with opening means for passage therethrough of screw means and passage of said screw means on into said door frame for more secure mounting of said planar lock plate.

6. The portable positive dead bolt door lock of claim 5, wherein said opening means is two screw holes in said planar lock plate for the passage therethrough of two screws on into said door frame.

* * * * *